US008419000B2

(12) United States Patent
St. John

(10) Patent No.: US 8,419,000 B2
(45) Date of Patent: Apr. 16, 2013

(54) DEVICE, KIT, AND METHOD FOR MAINTAINING A PLURALITY OF DOORS IN AN UPRIGHT POSITION FOR TREATMENT

(76) Inventor: Marcel St. John, Belle Riviere (CA)

( * ) Notice: Subject to any disclaimer, the term of this patent is extended or adjusted under 35 U.S.C. 154(b) by 516 days.

(21) Appl. No.: 12/701,426

(22) Filed: Feb. 5, 2010

(65) Prior Publication Data

US 2011/0193279 A1 Aug. 11, 2011

(51) Int. Cl.
*B25B 3/00* (2006.01)
*B05C 21/00* (2006.01)

(52) U.S. Cl.
USPC ..... 269/1; 118/500; 269/905

(58) Field of Classification Search ..... 269/1, 36, 269/37, 40, 905; 118/500
See application file for complete search history.

(56) References Cited

U.S. PATENT DOCUMENTS

| | | | | | |
|---|---|---|---|---|---|
| 1,055,937 | A * | 3/1913 | Mitchell | ..... | 269/37 |
| 1,345,177 | A * | 6/1920 | Heckathorn | ..... | 269/64 |
| 1,648,376 | A * | 11/1927 | Blodgett | ..... | 269/38 |
| 2,814,321 | A | 11/1957 | Haack | | |
| 4,099,347 | A | 7/1978 | Sharp | | |
| 5,503,278 | A * | 4/1996 | Ishmael | ..... | 211/169 |
| 5,551,980 | A * | 9/1996 | Turnbo | ..... | 118/500 |
| 5,846,016 | A * | 12/1998 | Martinez et al. | ..... | 403/388 |
| 5,894,945 | A | 4/1999 | Curran | | |
| 6,702,130 | B1 | 3/2004 | Carlilse | | |
| 7,481,323 | B2 * | 1/2009 | Fisher | ..... | 211/189 |

* cited by examiner

*Primary Examiner* — Lee D Wilson
*Assistant Examiner* — Jamal Daniel

(57) ABSTRACT

A device for maintaining a plurality of doors in an upright and spaced position for treatment is provided. The device comprises a body with a plurality of radially extending hinge plate connectors each for connecting to a respective hinge plate. Also provided is a kit for assembling the device and a method for maintaining a plurality of doors in an upright and spaced position for treatment.

21 Claims, 8 Drawing Sheets

FIG. 9a
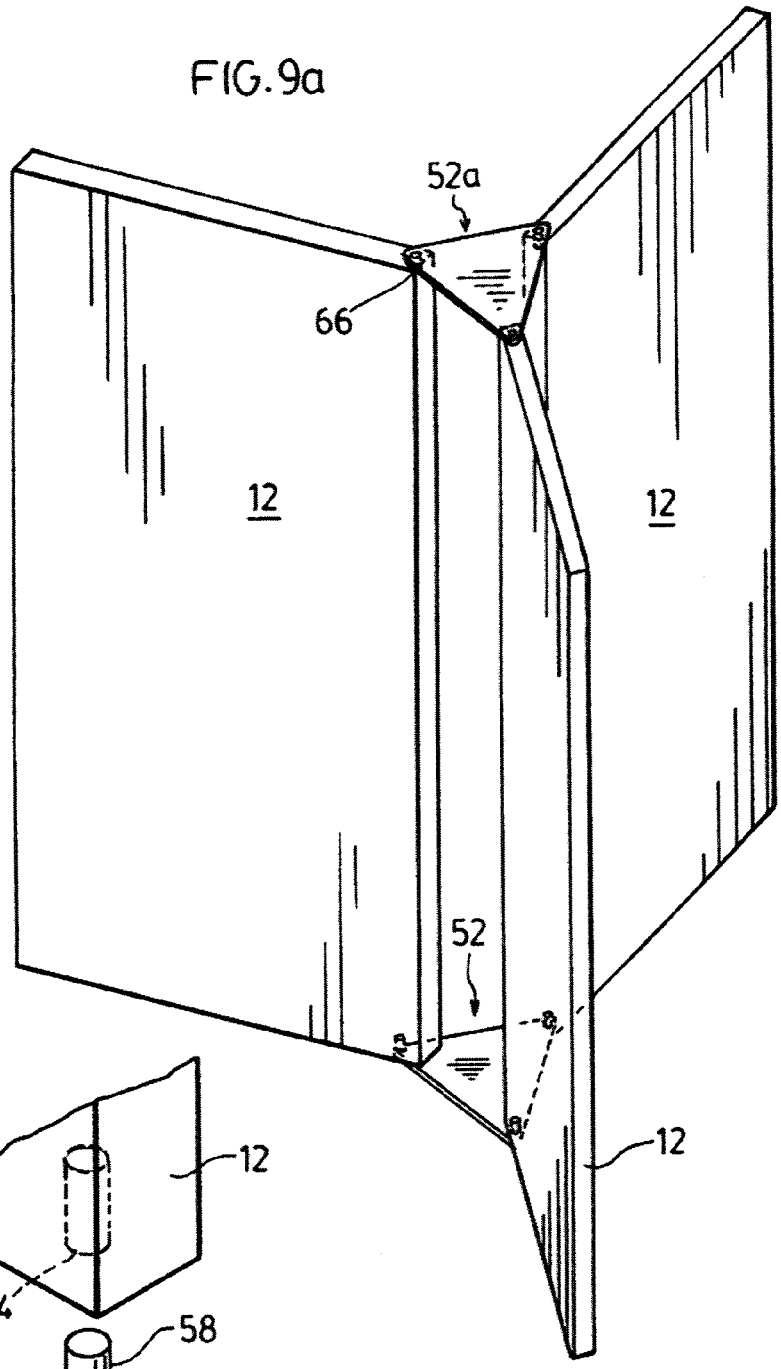
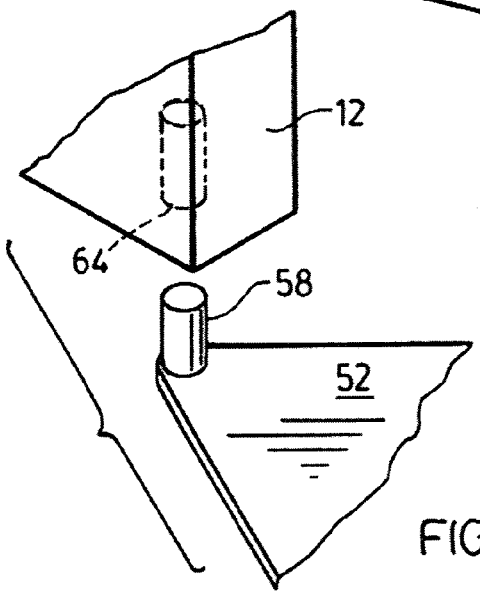
FIG. 9b

DEVICE, KIT, AND METHOD FOR MAINTAINING A PLURALITY OF DOORS IN AN UPRIGHT POSITION FOR TREATMENT

FIELD OF THE INVENTION

The present invention relates to doors. More specifically, the present invention relates to a device for maintaining a plurality of doors in an upright and spaced position for treatment, a kit for the device, and method employing the device.

BACKGROUND OF THE INVENTION

During construction of a building such as a house or office complex, one door to as many doors as are desired, may require treatment such as the application of paint or finishing materials such as stains or the like prior to being installed into a door opening or doorframe. One common method of positioning the door for treatment is to rest the door on one of its surfaces and treat the opposing surface. After the surface is treated, the door is flipped and the untreated surface of the door is then treated. Such a method is time-consuming and requires excessive handling of the door. Additionally, as the door is generally slanted during the treatment, excess paint or other finishing materials can tend to collect in a particular location resulting in an uneven treatment.

In order to address such problems, door finishing racks have been proposed wherein the door is hung from a rack and is completely treated while held within the rack. While such prior art devices work with varying degrees of efficiency, they tend to suffer from one or more drawbacks. Many door finishing racks are unusually complex in design and construction, making the racks expensive to manufacture and time-consuming to assemble and use. Exemplary door finishing racks of the prior art include U.S. Pat. Nos. 2,814,321; 5,551,980; 5,894,945; and 6,702,130. These devices have limited functionality and are large and cumbersome to transport from one construction site to another, thereby making such racks of limited value to a builder. U.S. Pat. No. 5,846,016 discloses a portable device that connects to the hinge attachment location on the door, however, it is time-consuming to affix the device to the attachment location and subsequently remove it after treatment has been completed. Furthermore, there is a considerable risk of damaging the screw holes in the hinge attachment locations of the door by cross-threading when attaching the device to the hinge attachment locations.

It is an object of the present invention to provide a device for maintaining a plurality of doors in an upright and spaced position for treatment that addresses the above-described drawbacks of the prior art.

SUMMARY OF THE INVENTION

In accordance with one aspect, there is provided a device for maintaining a plurality of doors in an upright and spaced position for treatment, the device comprising a body with a plurality of radially extending hinge plate connectors each for connecting to a respective hinge plate.

In accordance with another aspect, there is provided a kit for a device for maintaining a plurality of doors in an upright and spaced position for treatment, the kit comprising a plurality of complementary members for forming a device, the device comprising a body with a plurality of radially extending hinge plate connectors each for connecting to a respective hinge plate.

In accordance with another aspect, there is provided a method for maintaining a plurality of doors in an upright and spaced position for treatment, the method comprising attaching one portion of a plurality of hinge assemblies to a respective door; and attaching another portion of each hinge assembly to a hinge plate connector of a device, the device comprising a body with a plurality of radially extending hinge plate connectors.

Other features and advantages of the present invention will become apparent from the following detailed description. It should be understood, however, that the detailed description and the specific examples while indicating embodiments of the invention are given by way of illustration only, since various changes and modifications within the spirit and scope of the invention will become apparent to those skilled in the art from said detailed description.

BRIEF DESCRIPTION OF THE DRAWINGS

The present invention will become more fully understood from the detailed description given herein and from the accompanying drawings, which are given by way of illustration only and do not limit the intended scope of the invention.

FIG. 9*a* is a perspective view of a device for maintaining a plurality of doors in an upright and spaced position for treatment, according to another alternative embodiment; and FIG. 9*b* is a magnified perspective view of box A in FIG. 9*a*.

DETAILED DESCRIPTION OF THE INVENTION

Described herein is a device for maintaining a plurality of doors in an upright and spaced position for treatment, and a method employing the device and kit therefor.

Figure 1:
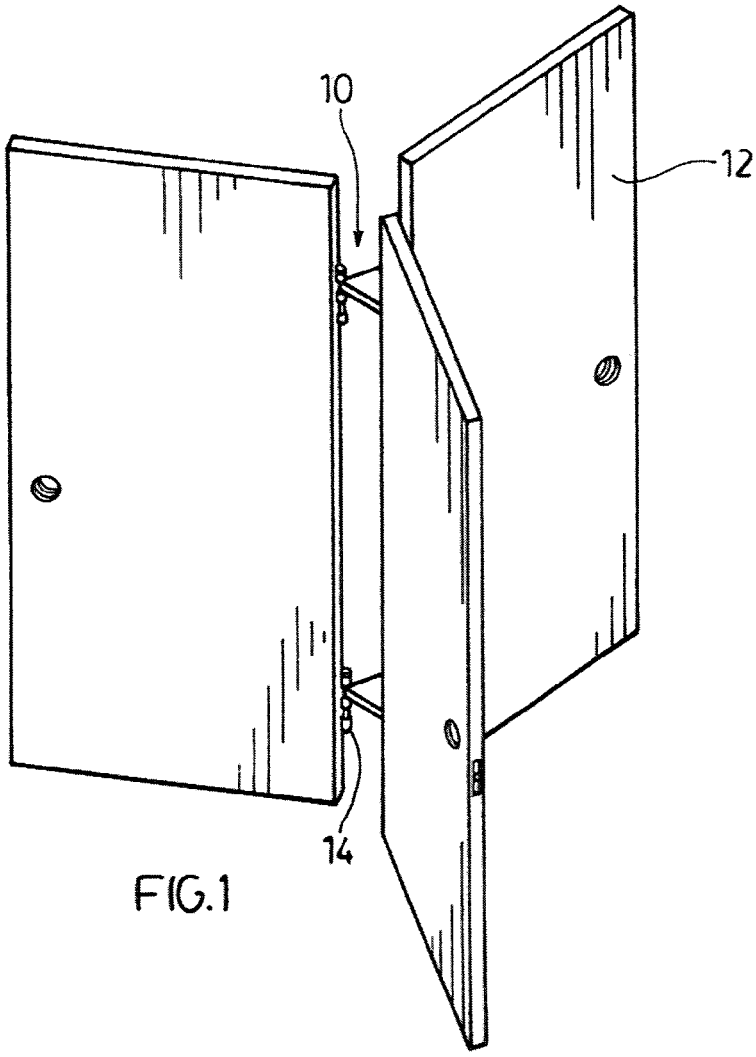
FIG. 1 is a perspective view of one embodiment of a device for maintaining a plurality of doors in an upright and spaced position for treatment, with connected doors.

FIGS. 1 to 4 show a device for maintaining a plurality of doors in an upright and spaced position for treatment, according to an embodiment that is generally identified by reference numeral 10. Turning now to FIG. 1, two devices 10 are connected to hinge plates 14 of the door hinge assemblies of three doors 12. In this way, the three doors 12 can be maintained in an upright position and access to each side of each door 12 for treatment is provided simultaneously. Typical door hinge assemblies comprise two identical hinge plates 14 pivotally mounted with respect to each other using a hinge pin 24. Thus, it does not matter which hinge plate 14 of a given hinge assembly is chosen for use with a respective device 10.

Figure 2:
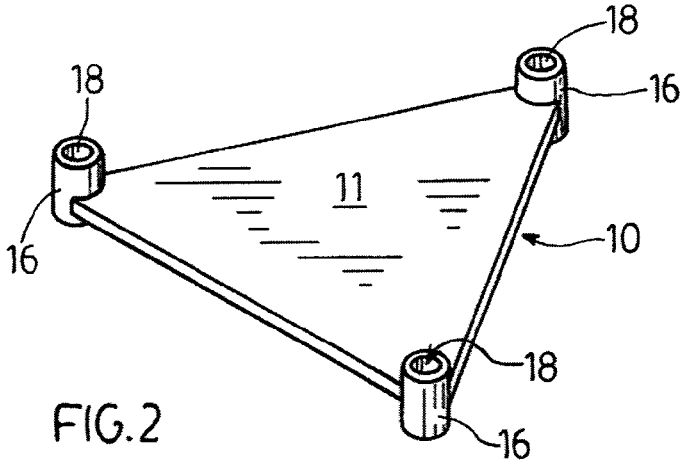
FIG. 2 is a perspective view of the device according to FIG. 1 in isolation.
Figure 3:
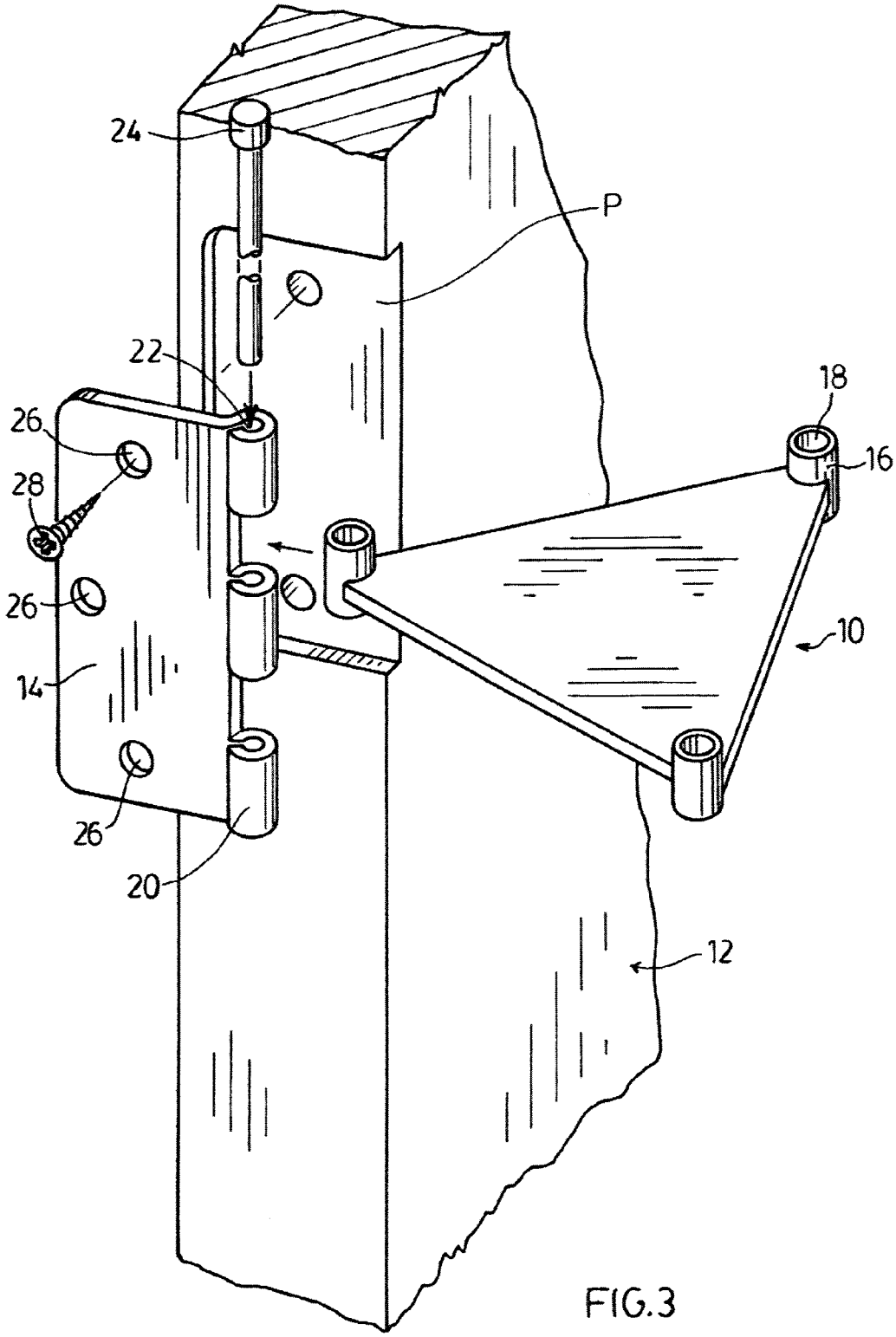
FIG. 3 is a view of the device shown in FIG. 1 being connected to a door.

Referring now to FIGS. 2 and 3, the device 10 comprises a generally triangular body 11 having three hinge plate connectors 16 radially extending from the body 11 for connecting to respective hinge plates 14. Each hinge plate connector 16 is positioned at a respective vertex of the body 11. Advantageously, each hinge plate connector 16 is spaced apart from each other hinge plate connector 16, such that when the device 10 is holding a plurality of doors 12, each side of each door 12 remains accessible for treatment. As depicted in FIGS. 1 through 4, each hinge plate connector 16 is substantially equidistant from each other hinge plate connector 16.

Each hinge plate connector 16 is provided as a lateral projection from the body defining a bore 18, and is, in this embodiment, generally a hollow cylinder. Each hinge plate connector 16 is dimensioned to mate with a respective hinge plate 14 by being received between two similarly-shaped lateral projections 20 on the hinge plate 14. The lateral projections 20, also known in the art as pintle pockets or knuckles, are aligned along a common axial bore 22 for receiving the hinge pin 24. Holes 26, for fastening each hinge plate 14 to a respective door 12 using fasteners 28, such as, for example, hinge screws, are also provided in each hinge plate 14.

Referring now to FIG. 3, which shows a device 10 being connected to a door 12, the hinge plate connector 16 and the lateral projections 20 of the hinge plate 14 mate, so that bores 18 and 22 are substantially aligned. In this way, hinge pin 24, or some other longitudinal fastener, can be inserted through bores 18 and 22, thus connecting the device 10 to the hinge plate 14.

Figure 4:
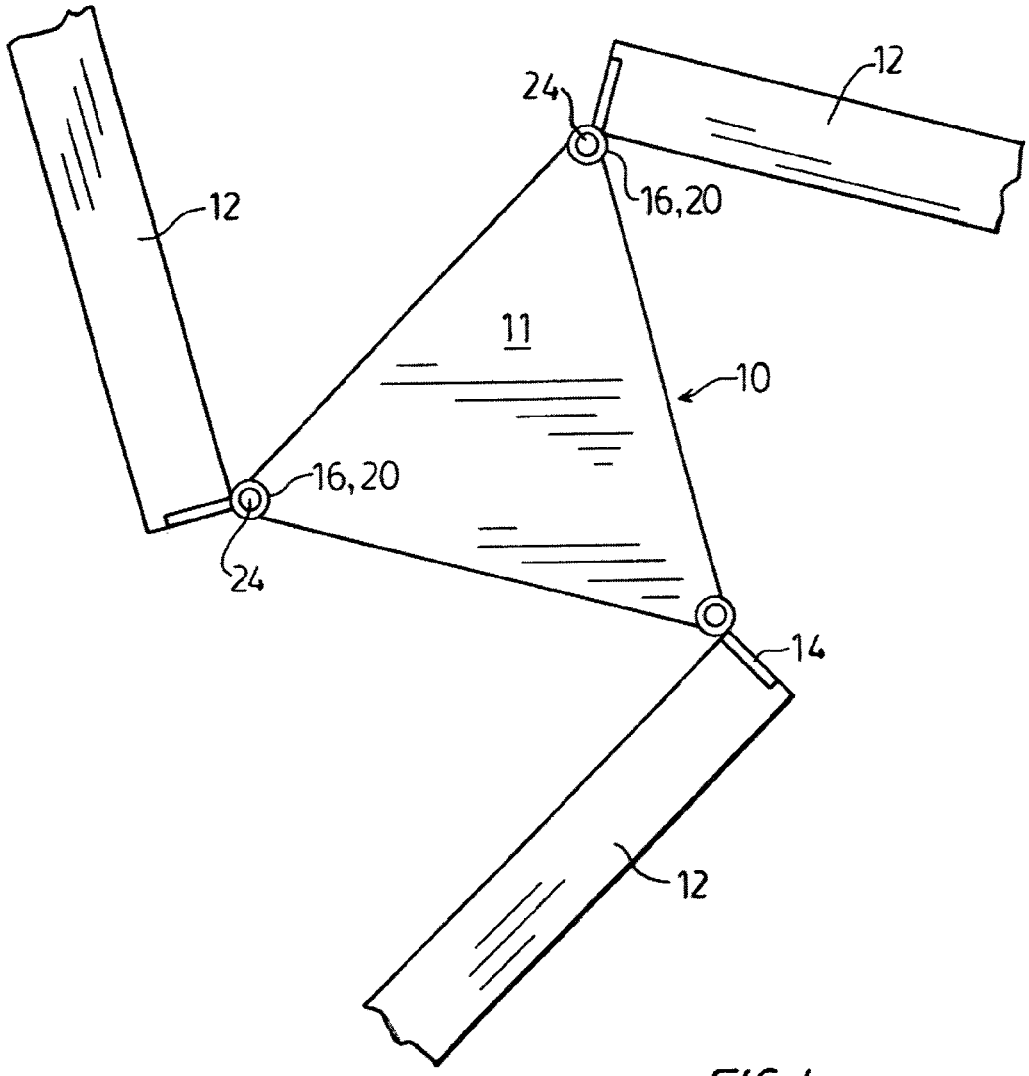
FIG. 4 is a top plan view of the device shown in FIG. 1 with connected doors.
Figure 5:
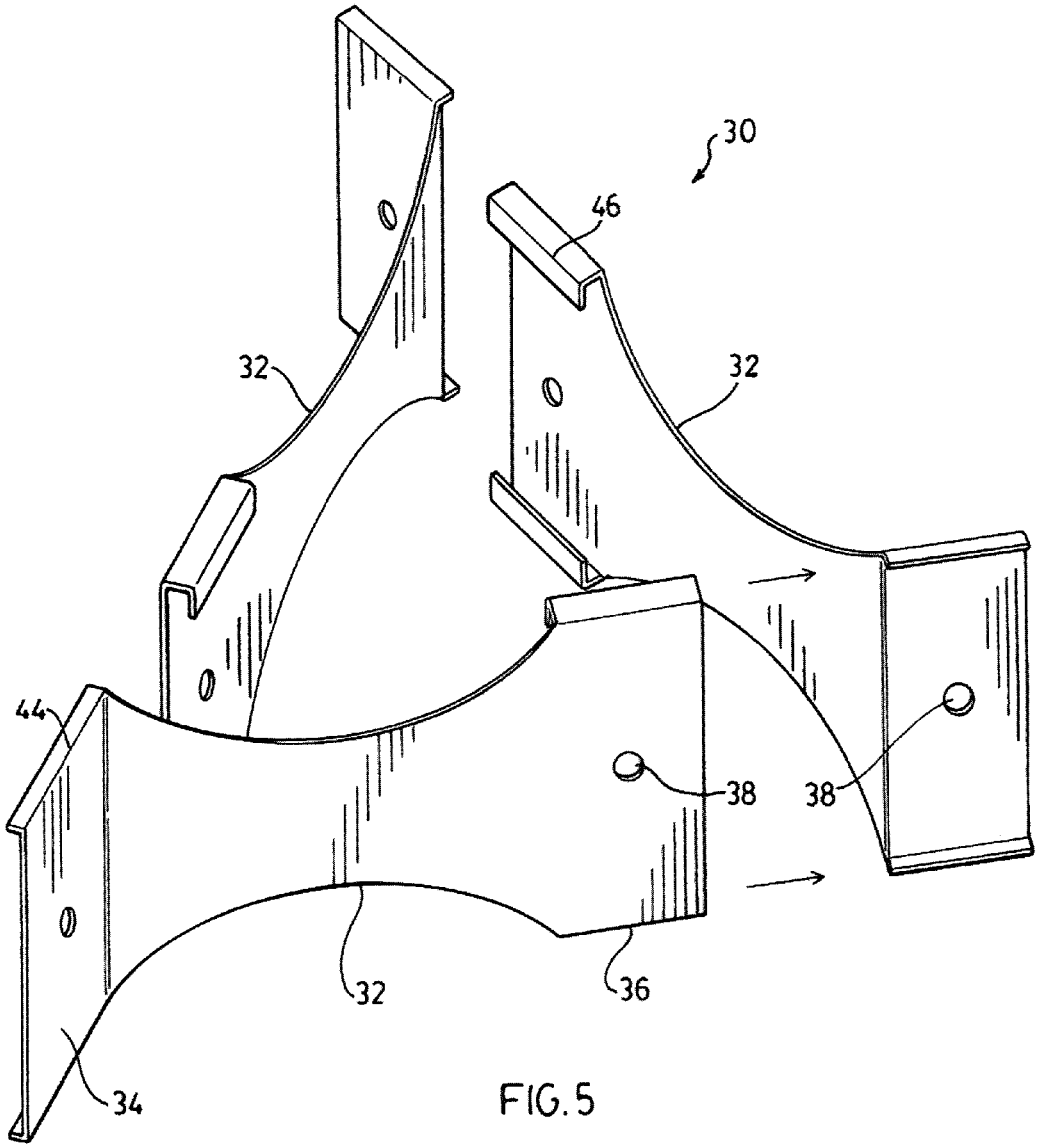
FIG. 5 is a perspective view of a device for maintaining a plurality of doors in an upright and spaced position for treatment, according to an alternative embodiment.
Figure 6:
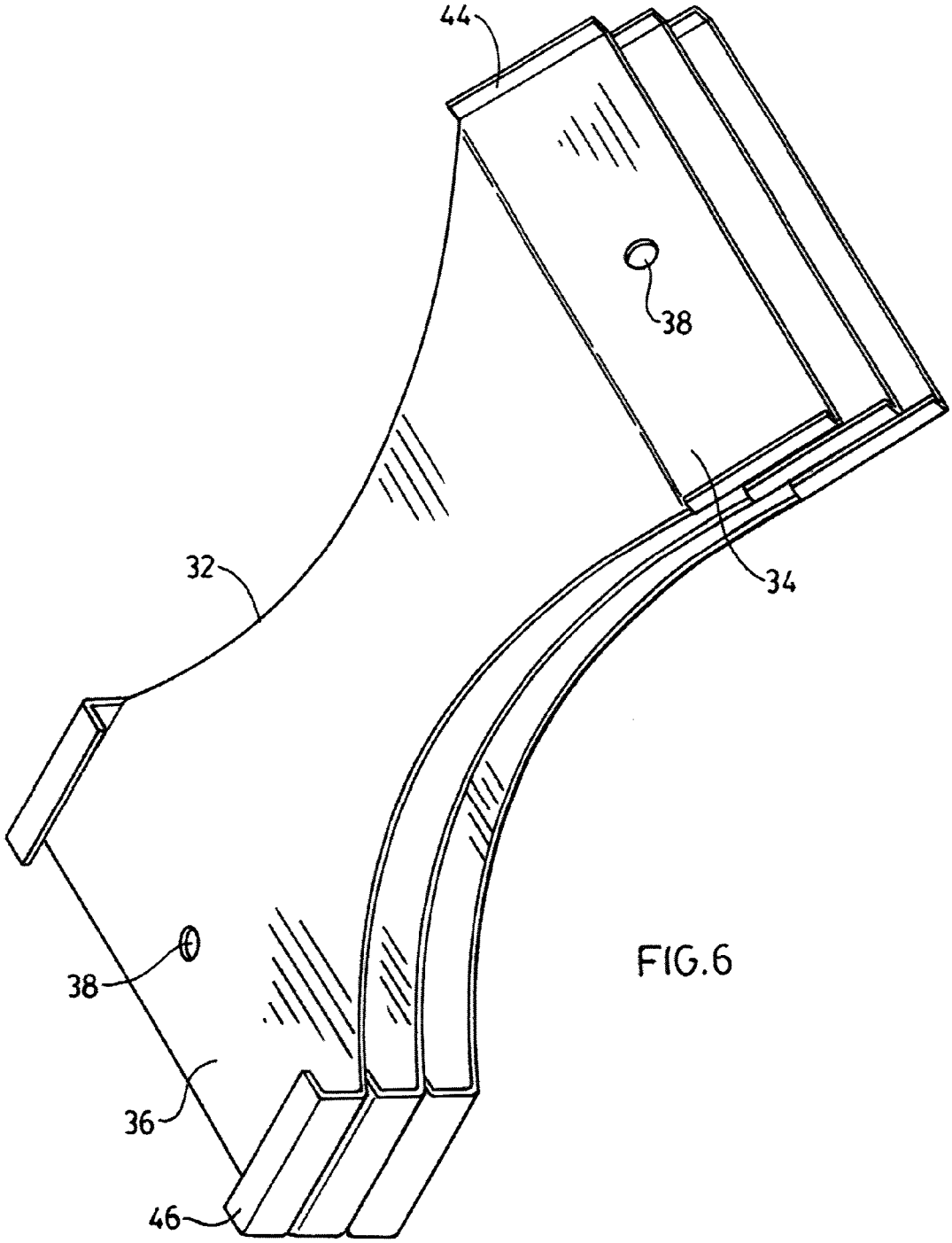
FIG. 6 is a perspective view of the device shown in FIG. 5 in an unassembled state.

During connection of the device 10 to a door 12, a hinge plate 14 is attached to the door 12, as is well known, in the position P shown in FIG. 3 using one or more fasteners 28. Preferably, the hinge plate 14, which will be eventually used to attach the door 12 to a door jamb using a second hinge plate 14, is used. In this way, the treatment process is simplified, and there is a lower risk of damage to the door, since it will not be required to remove or replace hinge plate 14 from door 12 after treatment. Once the hinge plate 14 is attached to the door 12, at least one device 10 is connected to the hinge plate 14. During connecting of device 10 to the hinge plate 14, hinge plate connector 16 of device 10 is mated with the lateral projections 20 of the hinge plate 14 so as to align bores 18 and 22. A hinge pin 24 is then passed through bores 18 and 22, thereby to connect the device 10 to the door 12. This process is repeated until all remaining hinge plate connectors 16 of the device 10 are coupled to respective hinge plates 14 attached to other doors 12, as is shown in FIGS. 1 and 4. Because of the way in which the door 12 is attached to the device, by the cooperation of the hinge plate 14 and the hinge plate connector 16, it will be understood that the doors 12 can pivot relative to the hinge plate connectors 16, and thus allow access to all sides of the doors 12, even when many doors 12 are attached to a single device 10. It will also be understood that the doors 12, when attached to the device 10, cooperate together to hold one another in a stable upright position FIGS. 5 to 8 show a device 30 for maintaining a plurality of doors in an upright and spaced position for treatment, according to an alternative embodiment. A body 31 (see FIG. 8) of the device 30 is formed by interconnecting three complementary members 32. Complementary members 32 are substantially identical and are shaped so as to cooperate with one another during assembly to form the device 30. Since the complementary members 32 are substantially identical, they can nest with each other for easy transport and storage, as is shown in FIG. 6. Turning now to FIG. 5, each complementary member 32 is a substantially elongate plate having a first end 34 and a second end 36. The plate is narrower at its middle than it is at first and second ends 34, 36, and the plate is concave. First and second ends 34, 36 each have a hole 38 therethrough and are shaped so that a first end 34 on one complementary member 32 mates with a second end 36 of another complementary member 32, and vice versa. When first and second ends 34, 36 are mated together, the hole 38 in first end 34 aligns with the hole 38 in second end 36. Once the device 30 is assembled as shown in FIG. 8, three hinge plate connectors 40, formed by the mating of respective ends 34 and 36, extend radially from the resultant body 31 and can be connected to a respective hinge plate 14 as will be described.

Figure 7A:
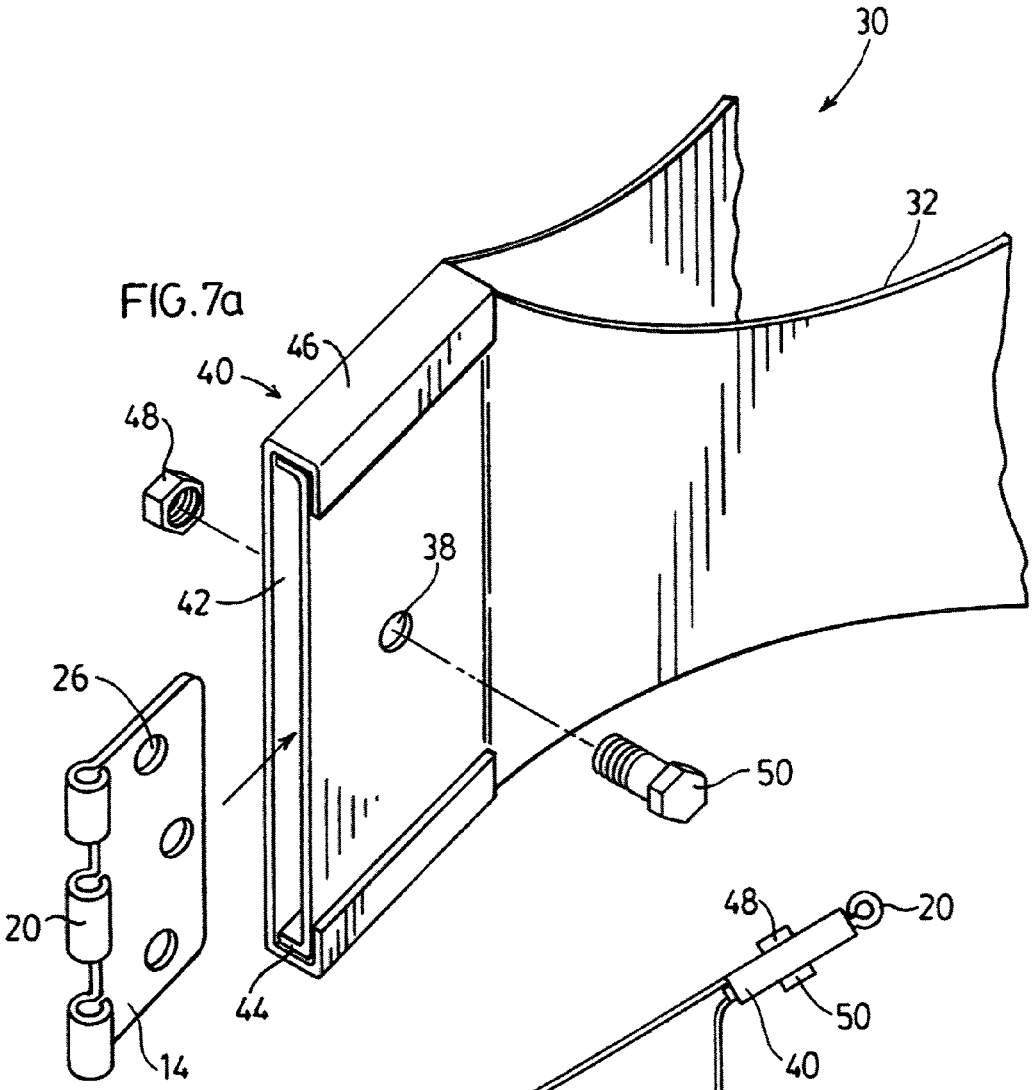
FIG. 7*a* is a perspective close-up view of the device shown in FIG. 5 being connected to a door hinge.
Figure 8:
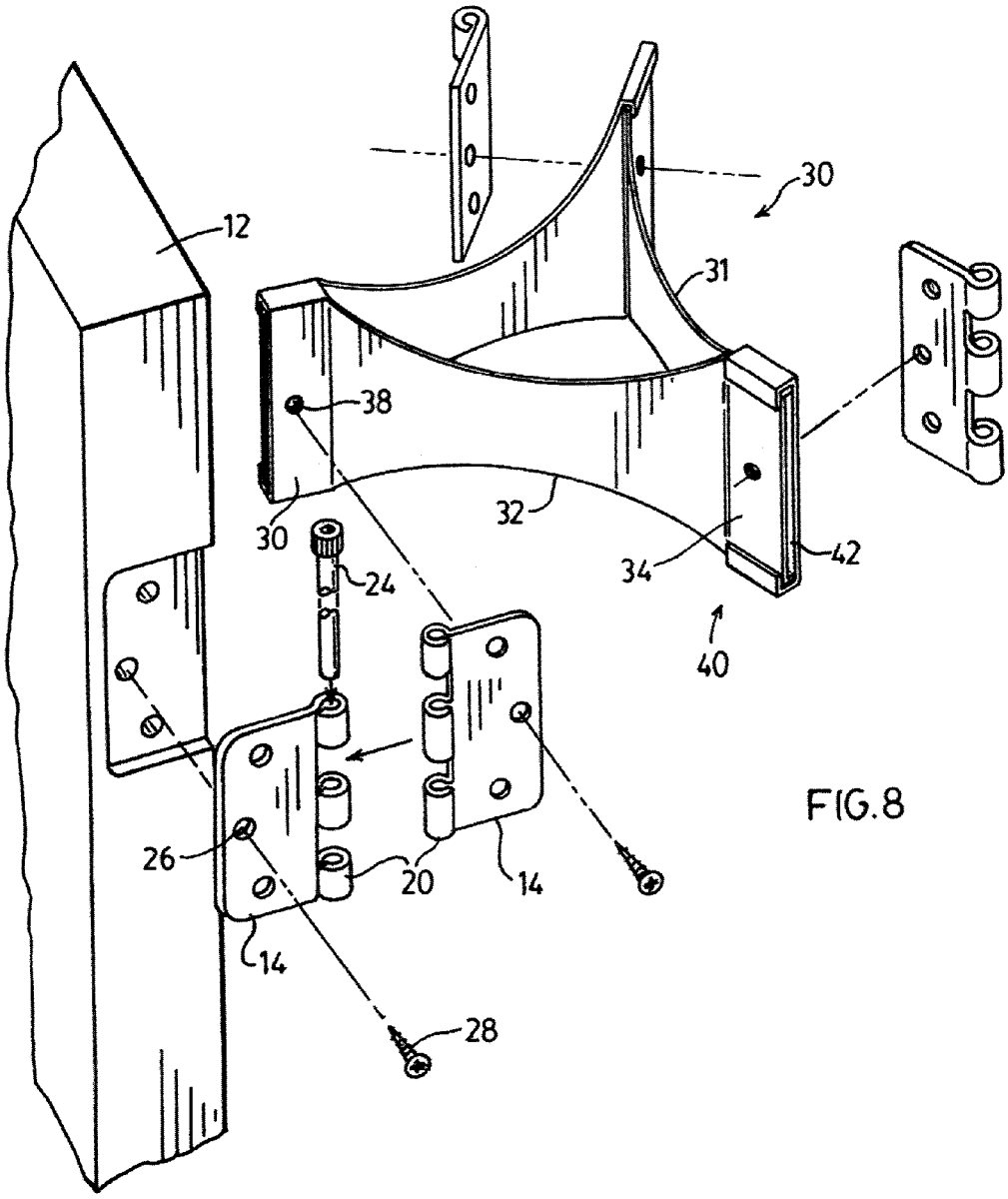
FIG. 8 is a view of the device shown in FIG. 5 being connected to a door.

Referring now to FIG. 7*a*, it can be seen that each first end 34 is received in a frictional fit by a second end 36 of another complementary member 32, forming a hinge receiver. In this embodiment, the hinge receiver is a slot 42 into which a hinge plate 14 may be received. The slot 42 is formed by virtue of spacers 44. Some hinge plates 14 may be too large to fit inside the slot 42, in which case they may be simply attached to the outside of the hinge plate connectors 40, as illustrated in FIG. 8. Each second end 36 is provided with brackets 46 that receive spacers 44 when first and second ends 34, 36 are mated, thus securing the first and second ends 34, 36 to one another. In this way, first and second ends 34, 36 can, to a degree, slide horizontally relative to one another but, due to the frictional fit and brackets 46, are not easily pulled apart or disassembled in other directions. Furthermore, each complementary member 32 is narrower between its two ends 34 and 36. The narrower portion, or concavity, imparts, depending on the material of each complementary member 32, resilience for maintaining a strong coupling of the complementary members 32 when combined to form the device 30. It will also be appreciated that the degree of narrowing may be such that there is a substantially parallel orientation where the ends 34 and 36 are engaged. This parallel orientation will be understood to facilitate in the sliding engagement of the ends 34 and 36 when combining the complementary members 32 to form the device 30.

Figure 7B:
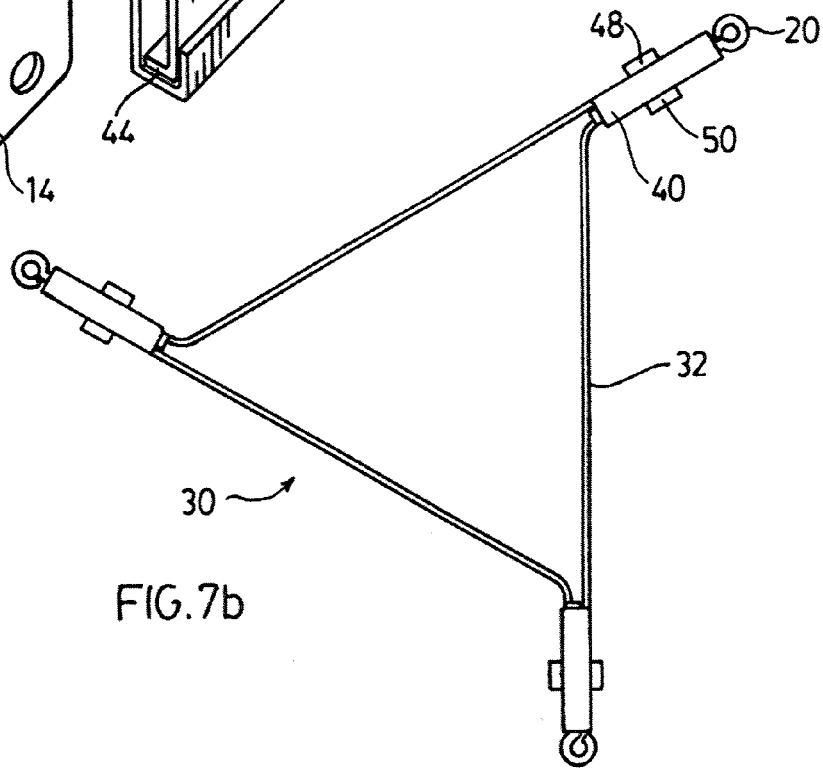
FIG. 7*b* is a top plan view of the device shown in FIG. 5.

Referring now to FIGS. 7 and 8, the slot 42, formed by the mating of ends 34 and 36, is preferably sized to receive a hinge plate 14. The hinge plate 14 can be secured within the slot 42, or alongside the slot 42 as seen in FIG. 8, by a fastener pin such as a screw 28 or nut 48 and bolt 50 combination. The fastener pin also aids in keeping the complementary members 32 together as a formed device 30. Once one hinge plate 14 is connected to the device 30, the device 30 can be attached to a door 12 comprising a second hinge plate 14, by simply coupling the hinge plates 14 with a hinge pin 24, as shown in FIG. 8.

During assembly of a device 30 from a kit of three complementary members 33, a first of the complementary members 32 is interconnected with a second of the complementary members 32 by slidingly receiving first end 34 of the first complementary member 32 within second end 36 of the second complementary member 32 in a frictional fit, so as to align the spacers 44 within the brackets 46 and the holes 38 thereof. First end 34 of the second complementary member 32 is then connected to a second end 36 of a third complementary member 32, in a similar manner. Finally, first end 34 of the third complementary member 32 is then connected to second end 36 of the first complementary member 32, thereby completing assembly. As is shown in FIG. 8, when the device 30 is assembled, the hinge plate connectors 40 are capable of receiving a respective hinge plate 14. The hinge plate connectors 40 are connected to the hinge plate connectors 40 with a fastener pin. The connected hinge plate 14 is then connected, using a hinge pin 24, to another hinge plate 14 connected to a door 12, thereby connecting device 30 to the door 12. This process is repeated until all hinge plate connectors 40 are connected to a respective door 12. Each door 12 is thereby pivotally attached to the device 30 and the doors 12 themselves cooperate together with the device 30 to maintain one another upright.

Referring now to FIGS. 9 and 9*a*, there is shown a device 52 for maintaining a plurality of doors in an upright and spaced position for treatment, according to another alternative embodiment. Device 52 may be used to interconnect doors without hinges. Device 52 may be employed as a base for supporting the plurality of doors 12, or as a cap that rests overtop of the plurality of doors 12. In this aspect, each of the doors 12 include a removable lower dowel 58 that extends downwardly from the underside of the door 12 and a removable upper dowel 60 that extends upwardly from the topside of the door. The dowels 58 and 60 are suitably dimensioned for insertion into bores 62 of the device 52, whether positioned as a base or a cap, found on radially extending portions of the body of the device 52.

A device 52 being employed as a base is placed on the ground and a door 12 is placed partially over the device 52. The lower dowel 58 is then aligned with the bore 62 of the device 52 and the door 12 is slidingly secured to the device 52. Another device 52*a*, being employed as a cap, is then placed partially overtop the door 12 so that the upper dowel 60 is then aligned with the bore 62 of the device 52*a* and the device 52*a* is slidingly secured to the door 12. The process is repeated until all doors 12 are coupled to both of the devices 52 and 52*a*. It will be appreciated that the dowels 58 and 60 are removably connected to the underside and topside of the door 12 by the provision of indents 64 and 66 in the underside and topside, respectively of the door 12. When the plurality of doors 12 have been treated, the dowels 58 and 60 are removed.

The devices 10, 30, and 52 may be constructed out of any material that can structurally support and interconnect a plurality of doors 12. For instance, the devices 10, 30, and 52 may be constructed out of metals such as, but not limited to sheet metal, aluminum, tin, bronze, and metal alloys. Alternatively, or in some combination, materials such as wood and polymeric materials such as, for example, plastics and rubber, may be employed.

In FIGS. 1 to 4, the device 10 is shown as having hinge plate connectors 16 that attach to a hinge plate 14 with a hinge pin 24. It is also contemplated that the device 10 could be provided with a hinge plate connector 40, similar to that used with device 30. In this aspect, the hinge plate connectors 40 would be provided already formed with device 10 rather than being formed by the cooperation of complementary members 32.

Although each complementary member 32 of device 30 has been described as a substantially elongate plate having first and second ends 34, 36, and the first and second ends 34, 36 have been described as comprising spacers 44 and brackets 46, respectively, it will be understood that the first and second ends 34, 36 could interconnect in an alternate manner, according to the principles set forth herein. For example, first and second ends 34, 36 could interconnect as male and female connectors. Alternatively, first and second ends 34, 36 could interconnect using a fastener or a clamp, for example. Additionally, the middle portion separating the first and second ends 34, 36 of a complementary member 32 need not be an elongate plate that is concave. For example, first and second ends 34, 36 could simply be separated by a web of another sort.

Although device 10 has been shown as being fabricated in one piece, alternatively the device 10 could be made from a plurality of complementary members 32, as herein described in reference to device 30. Furthermore, when the devices 10 or 30 are formed from complementary members 32, it is not vital that the respective hinge plate connectors 16 and 40 be formed from the interconnection of first and second ends 34, 36. The hinge connectors 16 and 40 could instead be formed from the body of the complementary members 32 between the first and second ends 34, 36, or the hinge connectors 16 and 40 could be separate pieces that are attachable to the body of the assembled device 10 or 30.

Furthermore, in FIGS. 5 to 8, the device 30 is depicted as being formed from a combination of three complementary members 32. However, it will be appreciated that the device 30 could alternatively be formed from a combination of as few as two complementary members 32. In this aspect, there could still be any number of spaced apart hinge plate connectors 40 for interconnecting the doors 12 so that each door 12 is in an upright position for treatment.

Although each of the devices 10, 30, and 52 has been described as holding three doors, the devices 10, 30, and 52 could be formed so as to hold any number of doors 12, provided the doors 12 are spaced sufficiently apart to allow a user access to each door 12 for treatment. For example, the devices 10, 30, and 52 could be formed to hold 1, 2, 3, 4, 5, 6, 7, 8, 9, or 10 doors. Alternatively, the devices 10, 30, and 52 could hold more than 10 doors. This may be accomplished, for example, by increasing the number of spaced apart hinge plate connectors 16 or 40 and/or proportionally increasing the size of the devices 10, 30, and 52. If the devices 10 and 30 are used to hold up only one door 12 for finishing, it may be helpful to couple at least one other unused hinge plate connector 16 or 40 of the device 10 or 30, respectively, to a hinge plate 14 fixed on a door frame or a supporting structure so as to stabilize the devices 10 and 30 and the doors 12. The devices 10, 30, and 52 may be modified to hold more than three doors up to as many as are desired.

The devices 10, 30, and 52 have been illustrated as being generally triangular and having radial symmetry with respect to the hinge plate connectors 16, 40, and bores 62, respectively. It will be understood however that the devices 10, 30, and 52 need not be triangular or symmetrical. The body of the devices 10, 30, and 52 should simply maintain the hinge plate connectors 16, 40, and bores 62 in a spaced relationship with respect to one another so that a user can access both sides of each door for treatment.

The hinge plate connector 16 of the device 10 has been described as defining a bore 18 in the body of device 10, however, the hinge plate connector 16 could alternatively comprise a protruding member (not shown). The protruding member could be substantially elongate with a circumference of about that of the size of a hinge pin 24. Furthermore, the protruding member could extend downwardly or upwardly in relation to the orientation of the door 12. During connection of a device 10 to a door 12, at least one device 10 is brought into proximity to a hinge plate 14 fastened to a door 12. The protruding member is aligned with the bore 22 defined by the lateral projections 20 of the hinge plate 14. The connection of the device 10 with the hinge plate 14 is effectuated by the downward or upward insertion of the protruding member, depending on its orientation, into the bore 22 defined by the lateral projections 20 of the hinge plate 14. In this aspect, the hinge pin 24 is not required as the protruding member acts to connect the device 10 to the door 12. The process is repeated until all remaining hinge plate connectors 16 of the device 10 are connected to a respective hinge plate 14.

In the aspects described above, typically two of each device 10 and 30 are used to interconnect a plurality of doors 12 because doors 12 typically have more than one mortised hinge recess for placement of hinge plates 14. However it will be appreciated that only one device 10 or 30 is sufficient to keep the doors 12 in an upright position for treatment. The devices 10 and 30 can also be used with doors that are not hinged by drilling holes into the side of the door 12 for attachment of the devices 10 and 30 thereto.

The device 52 could also be used in cooperation with devices 10 or 30. In this aspect, device 52 or both devices 52 and 52*a* could be used together with the device 10 or 30 to aid in further stabilizing the doors 12. This will be particularly useful when only one or two doors are being held simultaneously.

When introducing elements disclosed herein, the articles "a", "an", "the", and "said" are intended to mean that there are one or more of the elements. The terms "comprising", "having", "including" are intended to be open-ended and mean that there may be additional elements other than the listed elements.

With respect to the terms "coupled", "coupling" or "attached", these terms are understood to encompass integral with or connected thereto.

The description as set forth is not intended to be exhaustive or to limit the scope of the invention. Many modifications and variations are possible in light of the above teaching without departing from the spirit and scope of the following claims. It is contemplated that the use of the present invention can involve components having different characteristics. It is intended that the scope of the present invention be defined by the claims appended hereto, giving full cognizance to equivalents in all respects.

What is claimed is:

1. A device for maintaining a plurality of doors in an upright and spaced position for treatment, the device comprising a body with a plurality of radially extending hinge plate connectors each for connecting to a respective hinge plate, wherein the body comprises a plurality of complementary members, wherein the complementary members are identical, and wherein each complementary member comprises a first end and a second end being separated by a web, the first end and the second end forming complementary portions of a hinge receiver.

2. The device of claim 1, wherein each hinge receiver is for retaining a portion of the hinge plate during finishing.

3. The device of claim 2, wherein each hinge receiver comprises a slot for retaining the portion of the hinge plate.

4. The device of claim 2, wherein a pin retains the portion of the hinge plate to the hinge receiver.

5. The device of claim 4, wherein the pin is one of a screw and a bolt.

6. The device of claim 1, wherein each connector is substantially equidistant from each other connector.

7. The device of claim 1, wherein there are at least three hinge plate connectors.

8. The device of claim 7, wherein there are three hinge plate connectors.

9. The device of claim 1, wherein there are three complementary members.

10. The device of claim 1, wherein the web is generally concave.

11. A kit for a device for maintaining a plurality of doors in an upright and spaced position for treatment, the kit comprising a plurality of complementary members for forming a device, the device comprising a body with a plurality of radially extending hinge plate connectors each for connecting to a respective hinge plate, wherein the complementary members are identical, and wherein each complementary member comprises a first end and a second end being separated by a web, the first end and the second end forming complementary portions of a hinge receiver.

12. The kit of claim 11, wherein each a hinge receiver is for retaining a portion of the hinge plate during finishing.

13. The kit of claim 12, wherein each hinge receiver comprises a slot for retaining the portion of the hinge plate.

14. The kit of claim 12, wherein a pin retains the portion of the hinge plate to the hinge receiver.

15. The kit of claim 14, wherein the pin is one of a screw and a bolt.

16. The kit of claim 11, wherein each connector is substantially equidistant from each other connector.

17. The kit of claim 11, wherein there are at least three hinge plate connectors.

18. The kit of claim 17, wherein there are three hinge plate connectors.

19. The kit of claim 18, wherein the body is generally triangular and each hinge plate connector is positioned at a respective vertex of the generally triangular body.

20. The kit of claim 11, wherein there are three complementary members.

21. The kit of claim 11, wherein the web is generally concave.

* * * * *